United States Patent [19]

Melchior

[11] 3,998,199

[45] Dec. 21, 1976

[54] SUPERCHARGED INTERNAL COMBUSTION ENGINES

[75] Inventor: Jean Melchior, Paris, France

[73] Assignee: The French State, Paris, France

[22] Filed: Mar. 6, 1975

[21] Appl. No.: 555,740

Related U.S. Application Data

[63] Continuation-in-part of Ser. No. 344,513, March 26, 1973, abandoned.

[30] Foreign Application Priority Data

July 18, 1974 France ..... 74.24952

[52] U.S. Cl. ..... 123/188 GC; 123/90.33; 184/6.9

[51] Int. Cl.[2] ..... F01L 3/00

[58] Field of Search ..... 123/188 GC, 188 VA, 123/90.33, 90.1; 184/6.9, 24

[56] References Cited

UNITED STATES PATENTS

| | | | |
|---|---|---|---|
| 1,712,539 | 5/1929 | Willgoos | 123/188 GC |
| 1,819,663 | 8/1931 | Walker | 123/188 GC |
| 2,112,045 | 3/1938 | Puffer | 123/188 GC |
| 2,349,203 | 5/1944 | Spencer | 123/188 GC |
| 2,354,926 | 8/1944 | Patterson | 123/188 |
| 2,716,972 | 9/1955 | Farny et al. | 123/188 GC |
| 3,265,052 | 8/1966 | Goloff | 123/188 GC |

FOREIGN PATENTS OR APPLICATIONS

| | | | |
|---|---|---|---|
| 65,499 | 11/1966 | Germany | 123/188 GC |
| 774,619 | 5/1957 | United Kingdom | 123/188 GC |

*Primary Examiner*—Wendell E. Burns
*Assistant Examiner*—David D. Reynolds
*Attorney, Agent, or Firm*—Barnes, Kisselle, Raisch & Choate

[57] ABSTRACT

A supercharged Diesel engine comprises a valve whose stem is slidably received in a valve guide, the end of the valve stem co-operating with actuating means located in a casing and lubricated by oil splash. At least one cavity is formed in the inner wall of the valve guide in close proximity to the end of the valve guide closest to the valve disk and communicates permanently with atmospheric pressure or a pressure close to atmospheric pressure. The cavity communicates with atmospheric pressure or with a pressure in the neighborhood of atmospheric pressure or by at least one axial passage formed on the outside of the valve guide and is permanently fed with lubricating oil.

24 Claims, 4 Drawing Figures

SUPERCHARGED INTERNAL COMBUSTION ENGINES

CROSS REFERENCES TO RELATED APPLICATIONS

This is a continuation in part of copending U.S. Ser. No. 344,513 abandoned filed Mar. 26, 1973.

BACKGROUND OF THE DISCLOSURE

The invention relates to supercharged internal combustion engines comprising one or several valves (intake valves, exhaust valves, scavenging valves, etc.). In such engines, each poppet valve has a valve stem received in a valve guide and the end of the valve stem cooperates with actuating means (rocker, cam, etc.) shielded in a casing.

These actuating means are currently lubricated by oil splash and the sliding of the valve stem in the valve guide draws or carries along oil by a pumping effect, which ensures lubrication between the valve stem and the valve guide.

Each valve comprises a disk and a stem which is slidably received in a guide. A sufficient clearance should exist between the stem and the guide for the disk to be centered exactly with respect to its seat and for gas tightness to be achieved. A typial clearance is between 0.5 and 0.7 percent of the diameter of the stem. The actuating means are generally lubricated by oil splash and the reciprocating movement of the valve stem in the valve guide draws or carries along oil by a pumping effect which ensures lubrication between the valve stem and the valve guide. For instance, the reciprocating movement of the stem of an overhead rocker actuated valve draws lubricant from the casing into the clearance. While such a lubrication is sufficient for current engines, it is not satisfactory for engines with a high supercharging rate (particularly supercharged Diesel engines) since the pressure which prevails in the manifold passage close to the valve is quite in excess of the atmospheric pressure (higher than 6 bars in certain cases). The lubricating system should then fulfil two conditions which are contradictory to a certain extent. First, the oil pressure in that portion of the clearance which is close to the passage should be such that there is no oil "spill over" into the manifold since that would lead to an excessive oil consumption. On the other hand, the oil film between the valve guide and that portion of the valve stem which is close to the manifold should not be forced out by the gas under pressure.

In a prior art arrangement (German Pat. No. 1,236,860), a cavity in permanent communication with atmospheric pressure is formed in the inner wall of the valve guide adjacent to the valve stem and that cavity is located in the vicinity of the end of the valve guide which is closer to the valve disk. Grooves parallel to the stem axis are formed in the inner wall of the valve guide which slidably receives the valve stem and they extend from the cavity to the end of the valve guide which opens into the casing. That arrangement is not entirely satisfactory. Machining the inner wall of the valve guide is difficult. In operation, the film of oil between the inner wall of the valve guide and the valve stem may be ruptured.

In another prior art arrangement (East German Pat. No. 65,499), each valve of an engine is formed with an annular groove located close to the manifold. All annular grooves are communicated. The gas which flows along the valve stem tends to force part of the oil located in the groove of some valves (and which has flown from the casing) toward other valves. That arrangement is not satisfactory. Oil flow is pulsed rather than permanent. If the engine is supercharged, the oil flow is possible only toward the inlet valves. The volume of oil which is contained in the groove, part of which is forced into the connecting passages, is not sufficient for satisfactory lubrication of that part of the guide which is between the groove and that portion of the guide which is located close to the manifold. That oil which is forced by the pressurized gas is more or less emulsioned. Last, the flowing gas tends to rupture the oil film between the groove and the end portion of the guide.

In still another prior art arrangement (U.S Pat. No. 2,354,926), there is provided a passage for delivering pressurized oil into the valve stem clearance and an oil return passage which opens into the clearance at a point diametrically opposite from the oil inlet passage. The valve stem is formed with circumferetial grooves. Since a substantial clearance should be provided between the valve stem and the valve guide, there is a large oil leak to the intake or exhaust manifold with which the valve is associated. As an example, the oil leak along a clearance whose average value is 0.1 mm around a valve stem 16 mm in diameter is typically between 1.5 and 3.5 liters per hour, depending upon the degree of out-of-center of the stem in the guide. Such a leakage flow rate is not acceptable. In addition, the grooves formed in the valve stem are communicated with the passages only for short portions of the total duration of the cycle of operation of the engine, whereby oil renewal is not sufficiently fast.

It is an object of the invention to provide a lubrication system in which the above-mentioned short-comings are overcome.

It is a more particular object of the invention to provide a valve stem lubrication system which definitely prevents jamming, even if the valve is associated with an engine having a very high supercharging ratio and which, at the same time, does not lead to excessive oil consumption.

For that purpose, the end of the valve stem remote from the valve disk protrudes from one end of the guide into a casing which houses valve actuating means cooperable with the stem to reciprocate the valve, the valve actuating means being lubricated by oil in said chambers to which said one end of the valve guide is exposed to thereby provide a first oil supply means for feeding oil into the associated end of the radial clearance space between the stem and guide. The valve guide has first passageway means disposed circumferentially about and extending radially of said guide between the radial clearance space and the exterior of the guide to define a cavity in constant communication with the radial clearance space. The first passageway means is spaced from the other end of the valve guide by a distance measured axially of said stem which is approximately equal to the diameter of the valve stem or to the amount of reciprocating movement of the valve in operation. The valve guide has second passageway means constantly communicating said first passageway means with a pressure relief zone. Second oil supply means comprise an oil supply conduit in constant communication with the first passageway means to supply oil to the radial clearance space. The second passageway means conduct oil away from the first passageway means to the pressure relief zone.

According to another aspect of the invention, there is provided, in a supercharged internal combustion engine having at least a valve provided with a stem which is slidably received in a valve guide, the end portion of the stem remote from the valve disk co-operating with actuating means located in a casing, lubricating means comprising at least an annular cavity which permanently communicates with a return passage and is formed in the wall of the valve guide around the valve stem at a location close to the end porton of the valve guide which opens into a manifold branch associated with the valve, and a passage for feeding fresh oil into said cavity, wherein the passages are so arranged that the oil which in operation permanently flows through said cavity, communicating with the valve stem, is at a static pressure which is lower than the minimum pressure which prevails in said manifold in operation.

Due to that relation between the pressures, there cannot be any appreciable oil spill into the manifold. The end portion of the guide confronting the manifold is nevertheless lubricated satisfactorily due to the reciprocation of the valve stem which draws fresh oil from the cavity and consequently builds an oil film which prevents the gas from flowing out. The latter object is particularly fulfilled if the cavity opens in the inner surface of the valve guide at a distance from the end of the guide adjacent the manifold which is approximately equal to the amount of reciprocating movement of the valve, which is also approximately equal to the valve stem diameter.

For an appropriate static pressure to prevail in the cavity (that is a pressure which will generally be slightly higher than the atmospheric pressure, but close to the atmospheric pressure), it is sufficient that the return passage opens into the casing and that the passages be of such size with respect to each other that the head loss of the oil flow upstream of the cavity be much higher than the head loss downstream of the cavity, with the overall head loss being selected as a function of the oil inlet pressure for an optimum oil rate of flow to be achieved across the cavity. The head loss can be selected such that the pressure in the cavity of an inlet valve is different from, for instance slightly higher than, the pressure in the cavity of an exhaust valve.

Referring again to the prior art lubricating system disclosed in East German Pat. No. 65,499, it will be appreciated that there are fundamental differences in structure and operation. While in the present invention the end portion of the valve stem is lubricated with fresh oil, in said East German Patent there should inherently be a gas flow along the end portin of that valve from which emulsioned oil which has already circulated along the major portion of the valve stem is to be forced toward another valve. While the present invention may be used for lubricating an intake valve as well as an exhaust valve of a supercharged engine, there cannot be any flow of emulsioned oil toward an intake valve in the prior art device. While in the invention the permanent circulation of oil through the cavity does not interfere with the oil flow from the casing toward the cavity, which lubricates the portion of the stem remote from the valve disk, since there is no pressure build-up in the cavity, such a pressure build-up should occur in the prior art construction and apparently impedes oil flow along the upper portion of the stem. Last, it is not seen how the lower portion of intake valve stem, which is provided with the cavity from which oil is forced out to another valve, may be lubricated and apparently German patent construction relies on a bushing which cannot prevent overheating by the gas flowing from the manifold and binding.

The invention will be better understood from the following description of preferred embodiments of the invention, given by way of non-limitative examples. The description refers to the accompanying drawings wherein:

SHORT DESCRIPTION OF THE DRAWINGS

DESCRIPTION OF PREFERRED EMBODIMENTS

Figure 1:
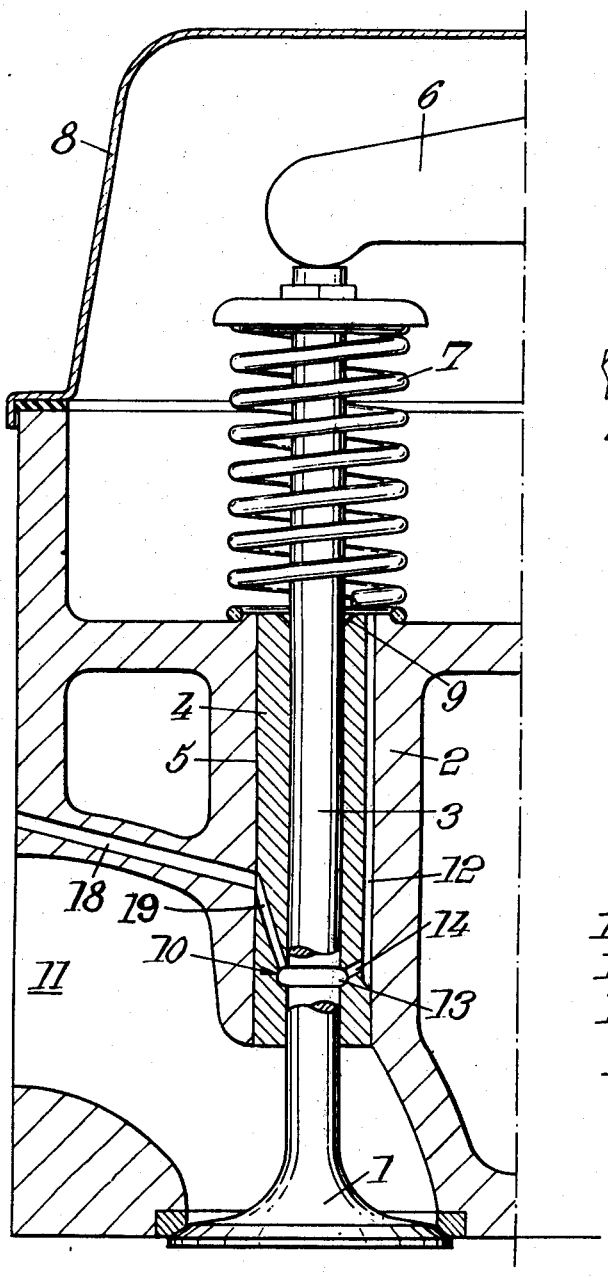
FIG. 1 is a diagrammatic axial section showing a valve according to a first embodiment of the invention.

Referring first to FIG. 1, there is shown a valve for a supercharged internal combustion engine. Since the engine may be of any conventional type, it will not be illustrated. However, reference may be had to the copending application of Jean MELCHIOR, Ser. No. 437,748 for having a description of an engine which may include intake and exhaust valves according to the invention.

The valve 1 is received in the cylinder 2 of the engine. It comprises a valve stem 3 which is slidably received in a valve guide 4. That guide may be formed as a sleeve retained in a bore formed in the cylinder head 2, for instance press fit into the bore 5.

The end of the valve stem 3 co-operates with actuating means, such as a rocker 6 and a spring 7. These actuating means are protected in a casing 8 and lubricated by oil splash due to a device (not shown) which, for example, can be constituted by a series of aspirating orifices arranged in a cam shaft actuating the rocker 6.

The valve stem 3 in the valve guide 4 draws oil by a pumping effect when it reciprocates in the valve guide 4 and ensures the lubrication between the valve stem 3 and the valve guide 4; to facilitate the pumping effect, the end of the valve guide 4 which opens into the casing 8 has a chamfer 9 on its edge which surrounds the valve stem 3.

At least one cavity 10 in permanent communication with atmospheric pressure (or with a pressure in the neighbourhood of atmospheric pressure) is formed in the inner wall of the valve guide 4 (against which the valve stem 3 slides). Cavity 10 may be placed in communication with the inside of the casing 8, in which substantially atmospheric pressure exists.

Cavity 10 is situated in the neighbourhood of the end of the valve guide 4 which opens into the exhaust manifold 11 ending at the valve 1 concerned, the distance separating said discharge cavity from said end being approximately equal to the diameter of the valve stem 3.

Cavity 10 is permanently communicated with the inside of the casing 8 by at least one axial passage 12 (groove or flat surface) formed on the outer wall of the valve guide 4. Such an axial passage 12 can be easily machined on the outer wall of the valve guide 4 before it is forced into the bore 5 of the cylinder head 2.

In the embodiment of FIG. 1, the cavity 10 is constituted by an annular groove 13 communicating with the axial passage 12 through a channel 14.

Figure 2:
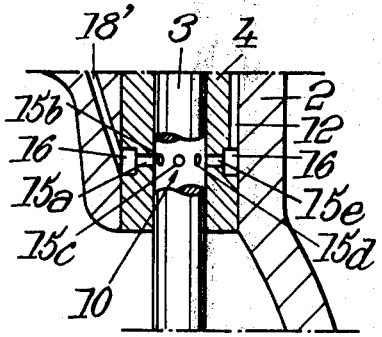
FIG. 2 is a partial diagrammatic section illustrating a modification of the embodiment of FIG. 1.

In the modified embodiment of FIG. 2 (where the same reference numerals denote the same members as in FIG. 1), the cavity 10 comprises several radial channels such as 15*a*, 15*b*, 15*c*, 15*d*, 15*e* distributed regularly and opening into an annular groove 16 formed on the outside of the valve guide 4 in which the axial passage 12 ends.

An oil supply pipe or conduit opens into the discharge cavity 10. In the embodiment of FIG. 1, this may consist of a passageway 18 in the engine head or block communicating with a passageway 19 in guide 4 leading to groove 13, and in the embodiment of FIG. 2 a similar passageway 18' leading directly to groove 16. Lubricating oil may be supplied to passages 18 or 18' in any suitable manner as will be well understood by those skilled in the art.

Figure 3:
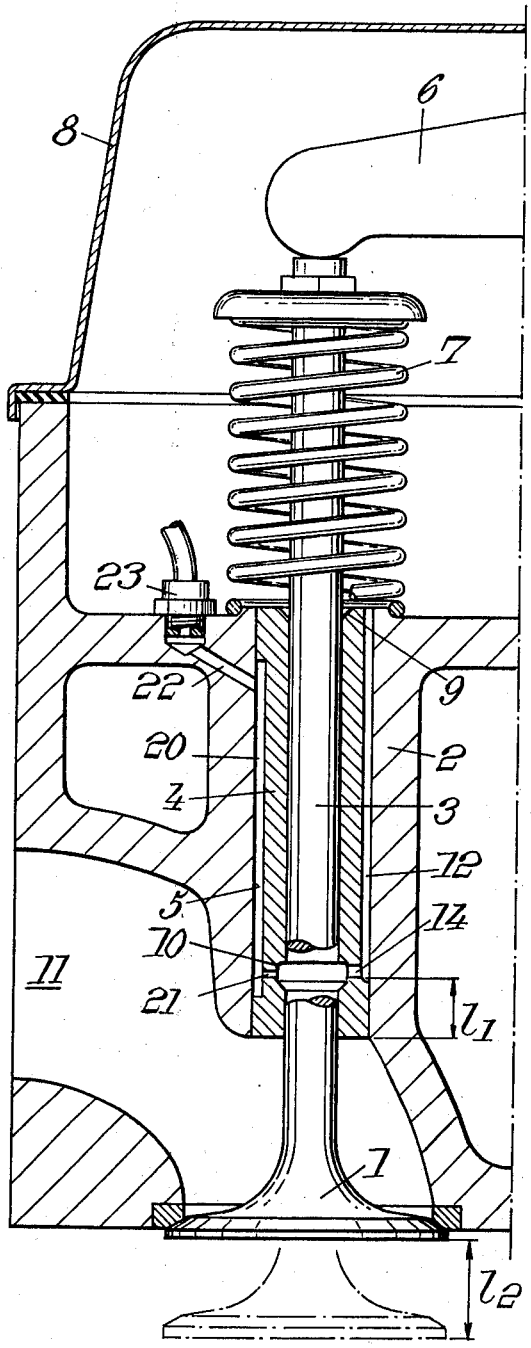
FIG. 3 is a diagrammatic axial section of another modified embodiment.

Referring now to FIG 3, there is shown a valve and the lubrication system for that valve according to another modified embodiment. For more clarity, the parts of FIG. 3 which correspond to parts already described on FIG. 1 are labelled with the same reference numerals. Only those portions which are different from the embodiment of FIG. 1 will now be described with particularity.

For maintaining an oil film between the end portion of the valve guide 4 which is adjacent to the manifold 11 (that is the lower portion on FIG. 3) and the stem 3, a cavity 10 which constitutes an oil storage volume is formed in the inner wall of the valve guide 4, at a distance $l_1$ from the lower surface of the guide which is smaller than the amount of reciprocating movement $l_2$ of the valve. A return passage or conduit permanently communicates the cavity 10 and a zone where the prevailing pressure is equal to or close to the atmospheric pressure. In the illustrated embodiment, the conduit comprises an axial groove 12 machined along the external wall of the guide 4 which opens into casing 8, and a port 14 connecting the groove 12 and the cavity 10. In addition, a conduit for permanently delivering oil into cavity 10 comprises a groove 20 which is similar to groove 12 but terminates short of both ends of the guide 4. That axial groove is connected by a port 21 with cavity 10 and by a passage 22 formed in the block to a connector 23. The connector 23 receives a pipe for delivery of pressurized oil from the overall pressure lubricating system of the engine.

Passages 14 and 21 are so dimensioned that the head loss of the oil which circulates from the connector 23 up to discharge into the casing is principally localized upstream of the cavity 10, for the pressure which prevails in the cavity to be close to the pressure in the casing (that is close to atmospheric pressure). That object may be fulfilled by forming the passage 22, the groove 20 and/or the port 21 with a cross-section much smaller than the cross-sections of the port 14 and groove 12. In addition, throughout the length of the return passage 12, the cross-sectional area is greater than the cross-sectional area in the cavity and upstream of the cavity. The flow rate of the oil which circulates from the connector 23 via the cavity 10 is essentially limited by the head loss upstream of the cavity and may be controlled by adjusting the size of the inlet passage. Typically, the pressure in the cavity will generally be controlled by giving a suitable size to the ports 21 and 14.

The ports 21 and 14 are preferably diametrically opposite. However, that condition is not absolutely essential and it may be necessary to depart from it due to other conditions to be fulfilled.

Numerous other embodiments are possible. For instance, several cavities may be distributed along the valve stem although in most cases that more intricate construction is not necessary for satisfactory results with an overhead valve. The cavity 10 may be in communication with the internal surface of the valve guide via ports or channels distributed regularly around the guide axis. That construction, which is similar to that illustrated at FIG. 2, renders machining of the internal wall of the guide easier. The passages 20 and 12 may be formed in past by a flat face cut on the outer surface of the guide, the respective passages 12 and 20 being defined by such flat faces and the cylindrical wall of the bore which receives the guide.

Since the operation of the device and the advantages over the prior art clearly appear from the foregoing description, it will not be necessary to describe it in full. That portion of the valve head which is remote from the manifold is lubricated by the "pumping" action of the stem which draws oil from the casing. That portion of the valve head which is close to the manifold is lubricated by a oil film which is drawn from the oil storage volume consisting of the cavity 10 to which a permanent flow of fresh oil is supplied. The oil film is equivalent to a plug which prevents the gas from leaking along the clearance. The oil cannot burn, since there is a permanent flow of fresh oil. An advantage of the permanent flow is that it cools the valve stem and this advantage is of particular importance for exhaust valves. Such advantages are gained without any spillover and consequently without any excessive consumption of oil, since the pressure in the storage volume is lower than the pressure which prevails in the manifold. Last, the need for availability of pressurized oil is not a drawback, since most engines have a lubrication system which operates under pressure. It is still to be noted that there is no need for additional accurate machining operation of the cylinder head and the conduits are of such size that they can be machined with current precision. For instance, the conduits may be limited by flat faces cut in the guide over a depth of about 1 mm if the inner diameter of the guide is 11 mm. The diameters of the ports 21 and 14 may then be 1.5 mm and 3 mm, respectively.

Figure 4:
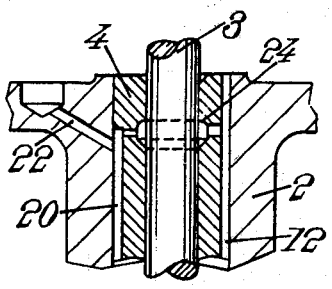
FIG. 4 is a partial axial section of still another modified embodiment, having two lubricating cavities.

A device according to the invention may be used with lateral valves and horizontal valves as well as with overhead valves. There may be provided one or more additional cavities such as 24 distributed along the stem and associated with a similar circuit, for instance connected between the passages 21 and 12 as indicated on FIG. 4 which illustrates the upper portion of a valve guide whose lower portion is similar to that of FIG. 3. For more clarity, the elements of FIG. 4 which have a counterpart on FIG. 3 are designated by the same reference numbers. With lateral valves and horizontal valves which are not splash lubricated at their end remote from the valve disk, two cavities, each located close to a respective end of the valve guide, are typically provided.

I claim:

1. In a combination with an intake and exhaust valve system, a valve lubrication system for a supercharged internal combustion engine having at least one poppet valve and an associated valve guide mounted in the engine, said valve having a stem with a constant diameter portion slidably mounted with a sliding fit in a constant diameter throughbore of said valve guide so as to define an oil lubricating clearance space radially between said stem and bore and open at the opposite ends of said guide such that oil fed into said radial clearance space is able to lubricate said stem in said guide bore by the oil pumping effect induced by reciprocation of said stem sliding in said bore, the improvement wherein the end of said valve stem remote from the valve poppet protrudes from one end of said guide into a shielded chamber housing valve actuating means cooperable with said stem to reciprocate said valve, said valve actuating means being lubricated by oil in said chamber to which said one end of said valve guide is exposed to thereby provide a first oil supply means for feeding oil into the associated end of said radial clearance space for lubricating said stem in said guide bore by said oil pumping effect, said valve guide having first passageway means disposed circumferentially about and extending radially of said guide between said radial clearance space and the exterior of said guide to thereby define a cavity in constant communication with said radial clearance space, said first passageway means being spaced from the other end of the valve guide which is closest to the valve poppet by a distance measured axially of said stem approximately equal to the diameter of the valve stem, said radial clearance space thus extending axially between said cavity and said one end of said guide and between said cavity and the other end of said guide, said valve guide having second passageway means constantly communicating said first passageway means with a pressure relief zone wherein the pressure is approximately atmospheric, and second oil supply means comprising an oil supply conduit in constant communication with said passageway means to supply oil at least via said first passageway means to said radial clearance space for lubricating at least the portion of said guide bore extending axially from said first passageway means to said other end of said guide by said pumping effect induced by reciprocation of said stem sliding in said bore past said first passageway means, said second passageway means serving to conduct oil away from said first passageway means to said pressure relief zone and also serving to prevent gas from flowing along said radial clearance space to said pressure relief zone while permitting the reciprocating movement of the stem to build a lubricating oil film throughout said clearance space.

2. The valve lubrication system set forth in claim 1, wherein said first pssageway means comprises an annular groove in said guide extending circumferentially therearound and channel means extending generally radially of said guide such that said groove and said channel means together connect said radial clearance space with the exterior of said guide, said second passageway means comprising a groove or flat formed in the external surface of the guide and extending axially of the guide from said first passageway means to said shielded chamber.

3. The valve lubrication system set forth in claim 2, wherein said oil supply conduit opens into said first passageway means.

4. The valve lubrication system set forth in claim 3, wherein said groove is disposed around the outer periphery of said valve guide and said channel means extends radially inwardly therefrom to said radial clearance space.

5. The valve lubrication system set forth in claim 3, wherein said groove is formed in the inner periphery of said guide bore and said channel means extends from said groove radially outwardly of the guide to said second passageway means.

6. The valve lubrication system set forth in claim 3, wherein said valve is oriented to serve as an overhead valve in said engine with said shielded chamber disposed above said valve guide and said valve guide extending downwardly therefrom with the valve poppet disposed below said other end of said guide.

7. The valve lubrication system set forth in claim 6, wherein said one end of said guide comprises the upper end thereof and has a chamfer communicating with said radial clearance space and adapted to collect oil from within said shielded chamber to thereby provide said first oil supply means.

8. In a supercharged internal combustion engine having at least a manifold and at least one valve, said valve having a valve disk adapted to close a brance of said manifold and a smooth valve stem having an uninterrupted surface, a stationary valve guide having an inner bore slidably receiving said valve stem with a relatively large clearance fit, said valve stem having an end portion whic projects out of said guide into a casing, and valve actuating means located in said casing and cooperating with said end portion of the valve stem, the improvement comprising at least one annular cavity formed in the valve guide around the valve stem and communicating with said inner bore in close proximity to that end of the valve guide which is adjacent the manifold branch, return passage means separate from the clearance space provided by said clearance fit and permanently communicating with said cavity, and oil supply passageway means separate from the clearance space provided by said clearance fit and permanently communicating with said cavity, and adapted to deliver oil to said cavity, whereby in operation oil is permanently and continuously circulated from said oil supply passageway means through said cavity into said return passage means, said oil supply passageway means and oil return passageway means being so proportioned that in operation the static pressure of the oil in said cavity is permanently lower than the pressure prevailing in the manifold branch, said clearance space extending axially in both directions from said cavity to the opposite ends of said guide.

9. Engine according to claim 8, wherein said cavity opens into the inner bore of the guide at a distance from the end portion of the guide which is approximately equal to the amount of reciprocating movement of the valve in operation.

10. Engine according to claim 9, wherein said static pressure is close to and higher than atmospheric pressure.

11. Engine according to claim 9, wherein said oil supply passageway means has a cross-sectional area in at least one section thereof which is substantially smaller than the smallest cross-section throughout the length of the return passageway means.

12. Engine according to claim 8, having means for feeding lubricating oil into the clearance between the valve guide which is remote from the manifold branch and the valve stem.

13. Engine according to claim 12, wherein said oil feeding means comprises a chamfer on the radially inner edge of the guide member arounnd said valve stem.

14. Engine according to claim 12, wherein said oil feeding means comprises at least another annular cavity formed in the valve guide in proximity to that end of the valve guide which is remote from the manifold branch, communicating with the inner surface of said valve guide and in permanent communication with said return passage means and oil supply passageway means.

15. In a valve lubrication system for intake and exhaust valves of a supercharged internal combustion engine having at least one poppet valve and an associated valve guide mounted in the engine, said valve having a stem with a constant diameter portion slidably mounted with a clearance fit in a throughbore of said valve guide so as to define a relatively large clearance space radially between said stem and bore and open at the opposite ends of said guide, said radial clearance space being sufficiently large radially between said stem and bore to enable the valve poppet to center itself onto its associated seat to achieve a gas tight fit therewith when said poppet valve is closed while maintaining said clearance fit of said stem in said bore, the improvement wherein one end of said valve stem remote from the valve poppet protrudes from one end of said guide into a shielded chamber housing valve actuating means cooperable with said stem to reciprocate said valve, first oil supply means for feeding oil into said radial clearance space adjacent said one end of said guide for lubricating said stem in said guide bore, said valve guide having first passageway means disposed circumferentially about and extending radially of said guide between said radial clearance space and the exterior of said guide to thereby define a cavity in constant communication with said radial clearance space, said first passageway means being spaced from the other end of the valve guide which is closest to the valve poppet by a distance measured axially of said stem approximately equal to the diameter of the valve stem, said valve guide having second passageway means constantly communicating said first passageway means with a pressure relief zone wherein the pressure is approximately atmospheric, and second oil supply means comprising an oil supply conduit in constant communication with said passageway means to supply oil via said first passageway means to aid radial clearance space for lubricating at least the portion of said guide bore extending axially from said first passageway means to said other end of said guide by the pumping effect induced by reciprocation of said stem past said first passageway means, said second passageway means serving to conduct oil away from said first passageway means to said pressure relief zone and also serving to prevent gas from flowing along said radial clearance space to said pressure relief zone while permitting the reciprocating movement of the stem to build a lubricating oil film.

16. The combination set forth in claim 15 wherein said one end of said guide is exposed to the oil supplied to said chamber for lubricating said valve actuating means, and wherein said first oil supply means comprises collecting means associated with said one end of said guide and operable to feed such chamber oil into the end of said radial clearance space exposed to said chamber.

17. The combination set forth in claim 15 wherein said second oil supply means comprises means for continuously supplying oil under pressure to said first passageway means and wherein said oil supply conduit and said second passageway means are so proportional such that in operation the static pressure of the oil in said first passageway means is continuously maintained at a value lower than that of the gas pressure prevailing in an engine gas conduit controlled by said valve poppet.

18. The combination set forth in claim 15 wherein said first passageway means comprises an annular groove in said guide extending circumferentially therearound and channel means extending generally radially of said guide such that said groove and said channel means together connect said radial clearance space with the exterior of said guide, said second passageway means comprising a groove or flat formed in the external surface of the guide and extending axially of the guide from said first passageway means to said shielded chamber.

19. The combination set forth in claim 18 wherein said oil supply conduit opens into said first passageway means.

20. The combination set forth in claim 19 wherein said groove is disposed around the outer periphery of said valve guide and said channel means extends radially inwardly therefrom to said radial clearance space.

21. The combination set forth in claim 19 wherein said groove is formed in the inner periphery of said guide bore and said channel means extends from said groove radially outwardly of the guide to said second passageway means.

22. The combination set forth in claim 15 wherein the static pressure of the oil in said first passageway means is close to and higher than atmospheric pressure.

23. The combination set forth in claim 22 wherein said first passageway means is disposed at a distance from said other end portion of said guide which is approximately equal to the amount of reciprocating movement of said valve in operation.

24. The combination set forth in claim 23 wherein said oil supply conduit has a cross section in at least one section thereof which is substantially smaller than the smallest cross section throughout the length of said second passageway means.

* * * * *